US012025034B2

(12) United States Patent
Cecil

(10) Patent No.: US 12,025,034 B2
(45) Date of Patent: Jul. 2, 2024

(54) ONE-PIECE CAMSHAFT BEARING CAP

(71) Applicant: Cummins Inc., Columbus, IN (US)

(72) Inventor: Adam C. Cecil, Columbus, IN (US)

(73) Assignee: Cummins Inc., Columbus, IN (US)

( * ) Notice: Subject to any disclaimer, the term of this patent is extended or adjusted under 35 U.S.C. 154(b) by 178 days.

(21) Appl. No.: 17/536,876

(22) Filed: Nov. 29, 2021

(65) Prior Publication Data

US 2022/0082034 A1 Mar. 17, 2022

Related U.S. Application Data

(63) Continuation of application No. PCT/US2020/034168, filed on May 22, 2020.
(Continued)

(51) Int. Cl.

| | |
|---|---|
| ***F01L 1/053*** | (2006.01) |
| ***F01L 1/344*** | (2006.01) |
| *F01L 1/047* | (2006.01) |

(52) U.S. Cl.
CPC ..... *F01L 1/053* (2013.01); *F01L 1/3442* (2013.01); *F01L 2001/0476* (2013.01);
(Continued)

(58) Field of Classification Search
CPC . F01L 1/053; F01L 1/3442; F01L 1/02; F01L 1/047; F01L 1/04; F01L 2001/0476;
(Continued)

(56) References Cited

U.S. PATENT DOCUMENTS 4,612,885 A * 9/1986 Yoshikawa ..... F01L 1/0532 123/90.27
4,957,079 A * 9/1990 Nakatani ..... F01M 9/102 123/90.34

(Continued)

FOREIGN PATENT DOCUMENTS

CN 203223260 U 10/2013
EP 1956222 A1 * 8/2008 ..... F01L 1/047

(Continued)

OTHER PUBLICATIONS

International Preliminary Report on Patentability; International Searching Authority; International Patent Application No. PCT/US2020/034168; Dec. 9, 2021; 8 pages.

(Continued)

*Primary Examiner* — Kenneth J Hansen
*Assistant Examiner* — Kelsey L Stanek
(74) *Attorney, Agent, or Firm* — Taft Stettinius & Hollister LLP

(57) ABSTRACT

A camshaft assembly for attachment to a cylinder head of an internal combustion engine, the camshaft assembly includes a one-piece camshaft bearing cap having an internal bearing surface sized to receive a portion of a camshaft therein, the internal bearing surface configured to support the portion of the camshaft between 180 degrees and 360 degrees circumferentially. The one-piece camshaft bearing cap is removable from the camshaft to enable line of sight access by an operator to the cylinder head. The internal bearing surface has oil supply grooves fluidly coupled to drillings for operation of a cam phaser assembled with a drive member and the camshaft. Head bolts are used to attach the cylinder head to the engine and are accessible upon removal of the camshaft bearing cap and camshaft. Standard camshaft
(Continued)

bearing caps can be assembled with the camshaft and the cylinder head at various attachment points.

17 Claims, 11 Drawing Sheets

Related U.S. Application Data

(60) Provisional application No. 62/855,027, filed on May 31, 2019.

(52) U.S. Cl.
CPC . *F01L 2001/0537* (2013.01); *F01L 2001/054* (2013.01); *F01L 2001/34423* (2013.01)

(58) Field of Classification Search
CPC ..... F01L 2001/054; F01L 2001/0537; F01L 2001/34423; F16C 35/00; F16C 35/02; F16C 35/04; F16C 35/042
USPC ..... 123/90.27, 90.34, 90.17; 74/567
See application file for complete search history.

(56) References Cited

U.S. PATENT DOCUMENTS

| | | | | |
|---|---|---|---|---|
| 5,887,557 | A | 3/1999 | Battlogg | |
| 7,647,912 | B2 | 1/2010 | Shibata et al. | |
| 8,056,521 | B2 | 11/2011 | Kreisig et al. | |
| 8,186,883 | B2 | 5/2012 | Nollenberger et al. | |
| 8,347,835 | B2 * | 1/2013 | Gallon | F01L 1/053 123/196 R |
| 8,590,499 | B2 | 11/2013 | Ilgeroth et al. | |
| 9,175,727 | B2 | 11/2015 | Kreisig et al. | |
| 9,322,430 | B2 | 4/2016 | Schuler et al. | |
| 10,054,017 | B2 | 8/2018 | Son et al. | |
| 2013/0269474 | A1 | 10/2013 | Gustafsson et al. | |
| 2017/0191444 | A1 | 7/2017 | Meusel et al. | |

FOREIGN PATENT DOCUMENTS

| | | | |
|---|---|---|---|
| EP | 1956222 | A1 | 5/2009 |
| WO | 2021014069 | A1 | 2/2012 |

OTHER PUBLICATIONS

International Search Report; International Searching Authority; International Patent Application No. PCT/US2020/034168; Aug. 25, 2020; 2 pages.

Written Opinion of the International Searching Authority; International Searching Authority; International Patent Application No. PCT/US2020/034168; Aug. 25, 2020; 11 pages.

* cited by examiner

ONE-PIECE CAMSHAFT BEARING CAP

CROSS-REFERENCE TO RELATED APPLICATIONS

The present application is a continuation of International PCT Application No. PCT/US2020/034168 filed on May 22, 2020, which claims the benefit of the filing date of U.S. Provisional Application No. 62/855,027 filed on May 31, 2019, the contents of each application is incorporated herein by reference in their entirety.

FIELD OF THE INVENTION

The present invention relates to a one-piece camshaft bearing cap, and more particularly, but not exclusively, relates to the one-piece camshaft bearing cap bolted to a cylinder head wherein the one-piece bearing cap is removable to enable access to machine an interface and/or assemble a fastener used to secure the cylinder head to the cylinder block.

BACKGROUND

A traditional camshaft cap integration at the drive end of an internal combustion engine is illustrated in FIG. 1. The camshaft cap located next to the camshaft drive is positioned just outside of the head bolt line of sight. As illustrated, the cylinder head includes a first head bolt located under an intake camshaft and a second head bolt located under an exhaust camshaft. The standard camshaft caps are easy to place and are located on the cylinder centerline. The lower part of the camshaft cap is integral to the cylinder head. The camshaft drive end caps are located at the edge of the head bolt on one side, while still allowing an operator access to tighten the head bolts. This secures the cylinder head to the cylinder block. The camshaft cap cannot be located over the top of the head bolt as the operator needs access to tighten the head bolts and the lower part of the camshaft cap would be eliminated while machining the head bolt boss. The distance of the head bolt, camshaft cap with bolts, and gear being positioned adjacent the cam cap determines the position of the camshaft drive plane. In this embodiment, the head bolt, camshaft cap, and gear cannot be positioned any closer.

FIGS. 2 and 3 illustrate a camshaft carrier on the engine which has a higher cost and increased complexity compared to the traditional camshaft cap integration illustrated in FIG. 1. The camshaft carrier has camshaft caps integrated in the camshaft carrier housing. A drive system or chain is adjacent the head bolt. The benefit of using a camshaft carrier are the camshaft caps can be positioned almost anywhere which is beneficial. However, the camshaft carrier housing is a separate, additional component which is expensive. The camshaft carrier housing is another major casting that must be purchased and accurately machined. The camshaft carrier housing also requires an additional oil seal between the camshaft carrier and the cylinder head along with additional fasteners and alignment dowels to mount the camshaft carrier to the cylinder head. This adds additional cost and complexity to achieve a shorter camshaft drive plane location. If a shorter length is required typical practice has been to use a camshaft carrier. The camshaft carrier separates the camshaft drive support from the cylinder head and the engine designer is no longer restricted to placing the final camshaft cap beyond the head bolt machining package. In fact, the camshaft bearing can be located directly over the head bolt boss.

As discussed above, in the case of a cylinder head with integral camshaft bearings for an overhead camshaft, locating the camshaft bearing nearest to the camshaft drive end has typically required packaging around the last set of head bolts. The drive end bearing is typically located right next to the minimum clearance required for machining the head bolt boss. This dimension sets the overall length of the camshaft drive and sets the location of the drive plane for all the components below it. If a shorter length for the engine is required, typical practice has been to use a camshaft carrier. The camshaft carrier separates the camshaft drive support from the cylinder head and the engine designer is no longer restricted to placing the final camshaft cap beyond the head bolt machining package. In fact, the camshaft bearing can be located directly over the head bolt boss, however, a camshaft carrier is another major casting that must be purchased and accurately machined. It also requires an additional oil seal between the camshaft carrier and the cylinder head along with additional fasteners and alignment dowels to mount the camshaft carrier to the cylinder head. This adds additional cost and complexity to achieve a shorter camshaft drive plane location.

SUMMARY

The present application utilizes a separate one-piece camshaft bearing cap that includes support for the upper and lower part of the camshaft drive end bearing surface. The camshaft drive end bearing surface can then be located directly above the head bolt in the same fashion as a camshaft carrier. The camshaft and the camshaft bearing cap can be removed for head bolt machining and head bolt assembly with the cylinder block and thereafter the camshaft can be installed directly above the head bolt along with the one-piece camshaft bearing cap and a drive gear together in a camshaft assembly. The one-piece or single piece design of the camshaft bearing cap allows it to fit easily over the drive end of the camshaft and receive a portion of the camshaft within an internal bearing surface of the camshaft bearing cap. Since the camshaft bearing cap positioned on the drive end of the camshaft is unique to support camshaft thrust loads and camshaft drive loads therefore no added cost is expected. Traditional camshaft supports utilize a two-piece design. The present application enables the benefit of a shorter camshaft drive plane without the need for a more complex and costly camshaft carrier.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION OF REPRESENTATIVE EMBODIMENTS

Figure 1:
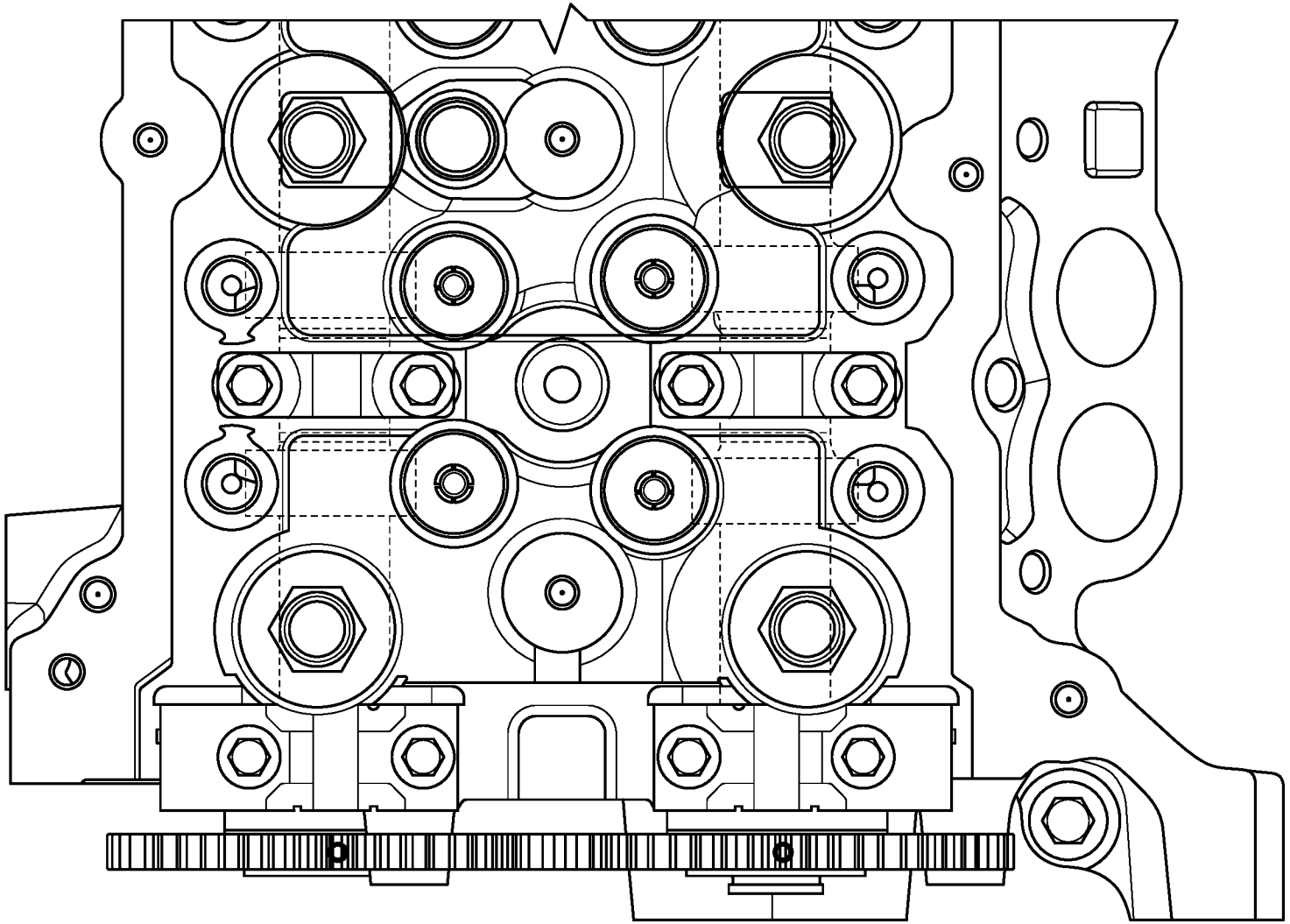
FIG. 1 is a top view of a standard camshaft cap integration at a drive end of an engine.
Figure 2:
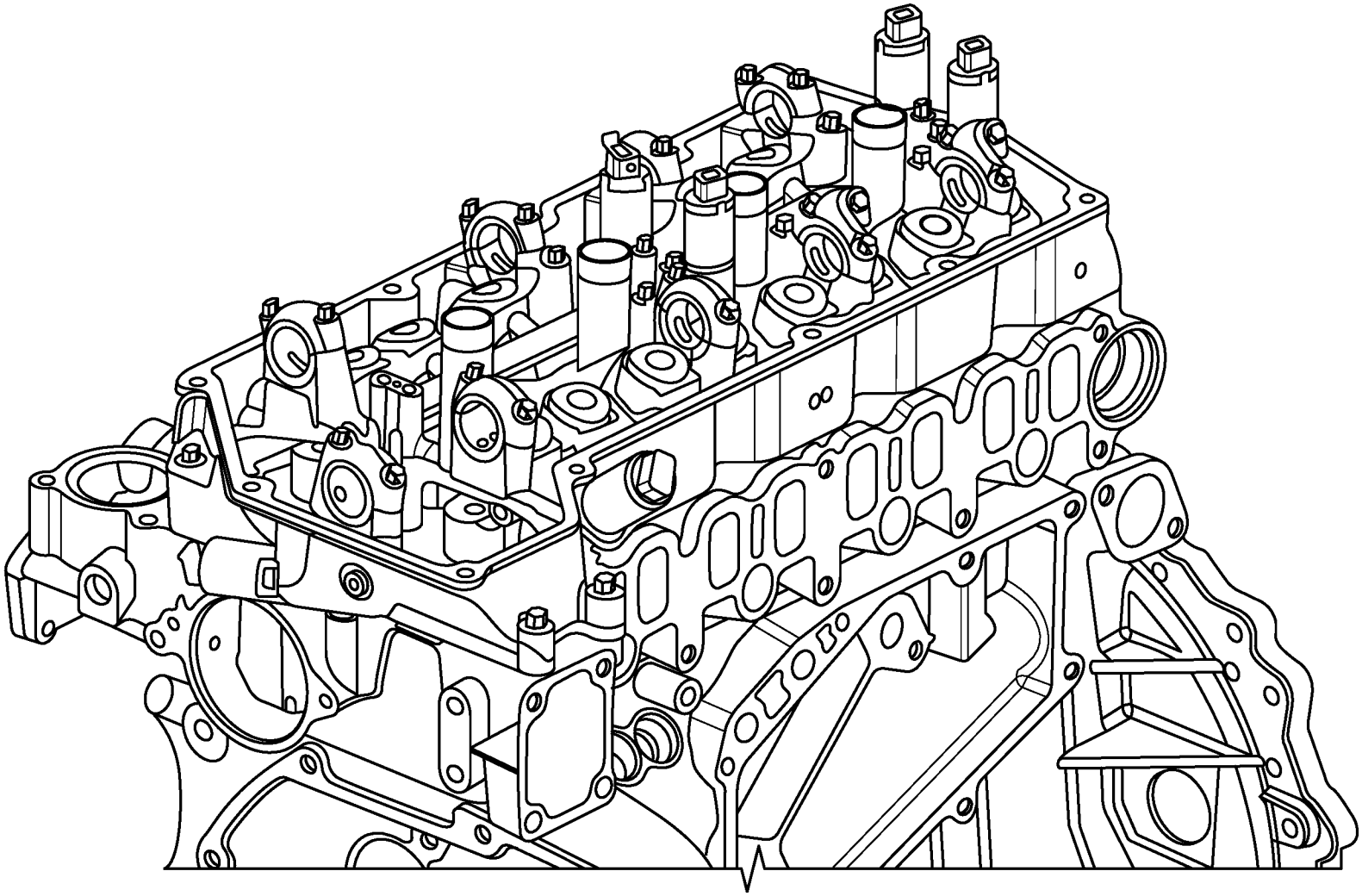
FIG. 2 is a side perspective view of a camshaft carrier on an engine.
Figure 3:
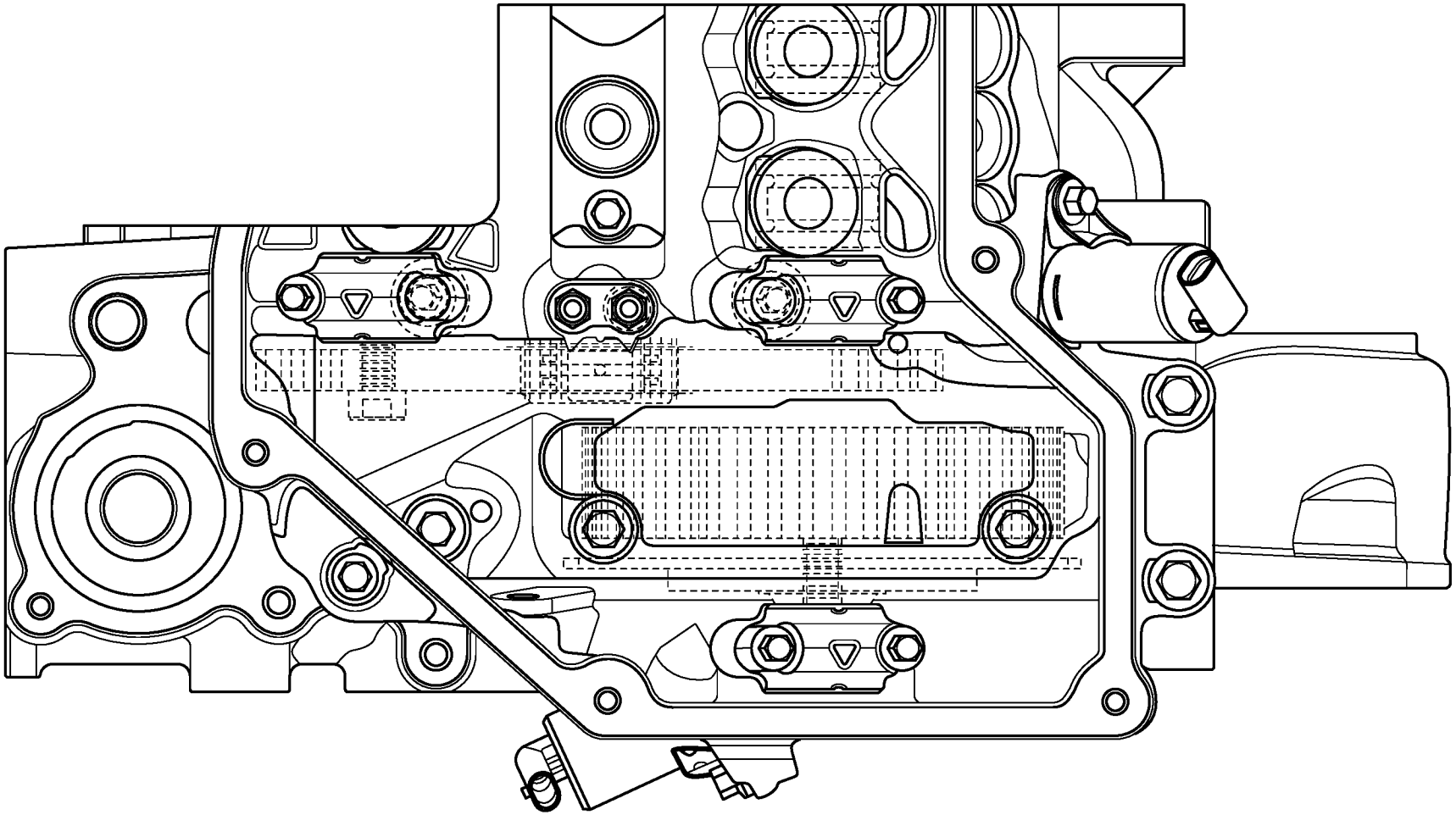
FIG. 3 is a top partial view of the FIG. 2 embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 4:
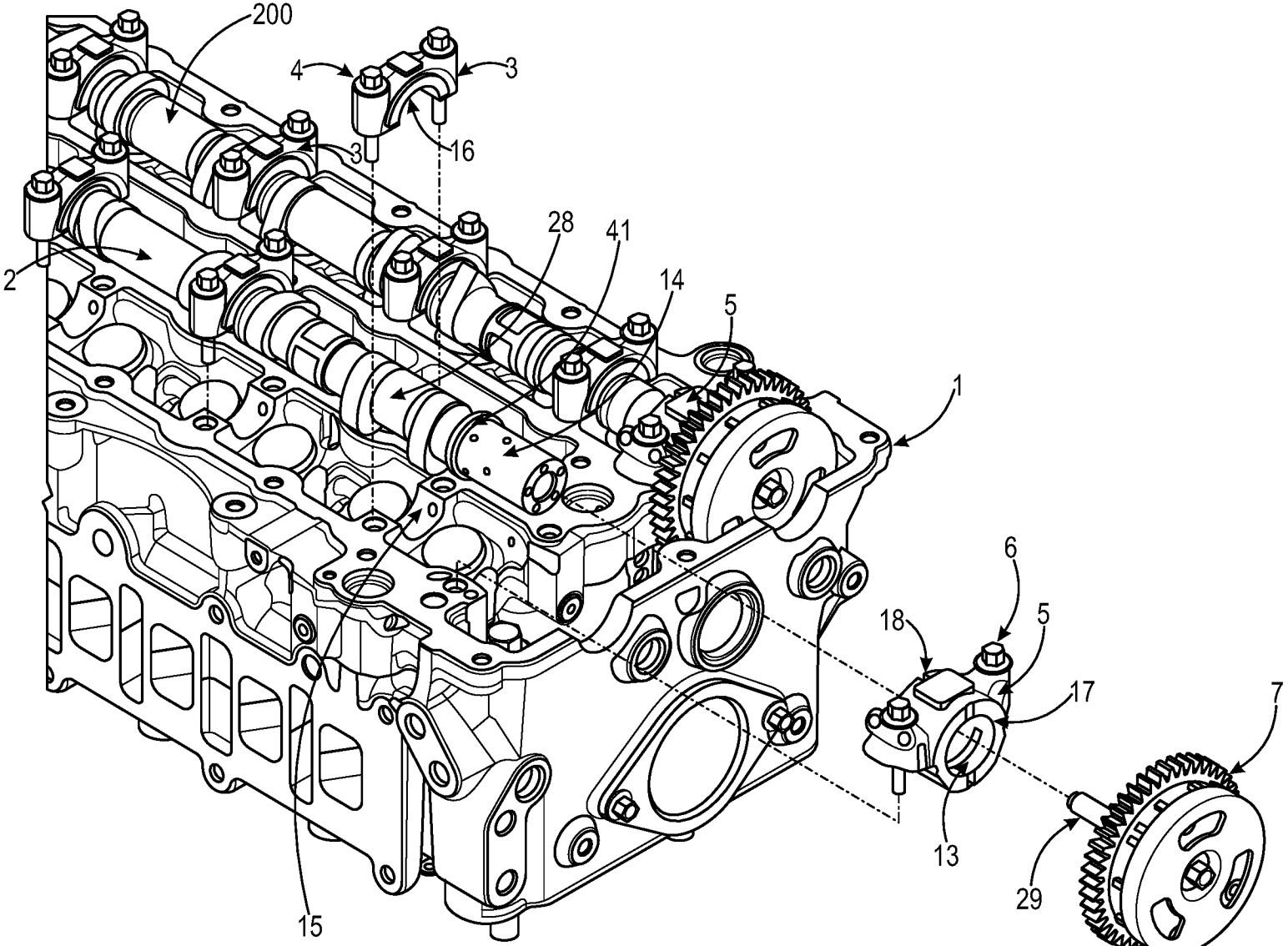
FIG. 4 is a top perspective view of a cylinder head assembly in an unassembled configuration according to the present application.
Figure 5:
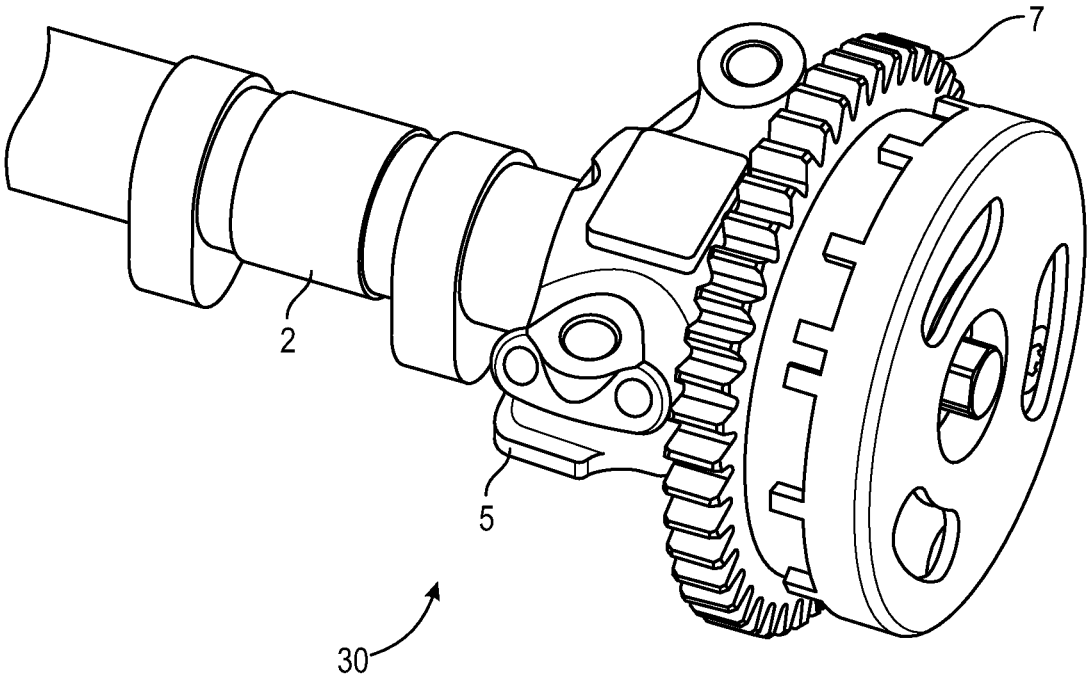
FIG. 5 is a partial perspective view of a camshaft assembly of the cylinder head assembly of FIG. 4.

As depicted in FIGS. 4 and 5, a cylinder head assembly 1 supports at least one camshaft 2 through at least one standard camshaft bearing cap 3 and at least one one-piece camshaft bearing cap 5. The cylinder head assembly 1 also supports a second camshaft 200 through at least one standard camshaft bearing cap 3 and at least one one-piece camshaft bearing cap 5. The camshafts 2 and 200 may be intake and exhaust camshafts, respectively. The standard camshaft bearing cap 3 is assembled with each of the camshafts 2 and 200. Similarly, the one-piece camshaft bearing cap 5 is assembled with each of the camshafts 2 and 200. The camshafts 2 and 200 each include a thrust collar 41 that engages against the one-piece camshaft bearing cap 5 when assembled.

The standard camshaft bearing 3 is mounted to the cylinder head assembly 1 using two mounting cap screws or mounting fasteners 4. Mounting cap screws or mounting fasteners 4 can include other types of fasteners to mount the standard camshaft bearing 3 onto the cylinder head assembly 1. The one-piece camshaft bearing cap 5 is mounted to the cylinder head assembly 1 using two mounting cap screws or mounting fasteners 6. Mounting cap screws or mounting fasteners 6 can include other types of fasteners to mount the one-piece camshaft bearing cap 5 to the cylinder head assembly 1. The standard camshaft bearing cap 3 supports at least one camshaft bearing surface 28 of the camshaft 2 through a lower bearing surface 15 that is integral to the cylinder head assembly 1 and an upper bearing surface 16 that is integral to the standard camshaft bearing cap 3. The one-piece camshaft bearing cap 5 supports at least one camshaft bearing surface 14 of the camshaft 2 through an internal bearing surface 13 that is integral to the one-piece camshaft bearing cap 5. In one embodiment, all of the lower and upper bearing surfaces 15, 16, and internal bearing surface 13 are machined at the same time with the camshaft bearing cap 3 and one-piece camshaft bearing cap 5 assembled to the cylinder head assembly 1 to ensure bearing alignment. In another embodiment, the lower and upper bearing surfaces 15, 16, and the internal bearing surface 13 are machined at different times with the one-piece camshaft bearing cap 5 assembled to the cylinder head assembly 1. For example, the one-piece camshaft bearing cap 5 can be formed from a base material used to create the overall shape and structure of the camshaft bearing cap 5 to form a base cap structure and a second material or separate assembled component, such as a bushing or roller bearing is assembled to the base cap structure to be used as the internal bearing interface 13 with the camshaft bearing surface 14. In this form, the second component can have the internal bearing surface greater than 180 degrees circumferentially and up to and including 360-degrees circumferentially. In any embodiment, the internal bearing surface 13 of the camshaft bearing cap 5 can support the camshaft bearing surface 14 of the camshaft 2 between 180 degrees and 360-degrees circumferentially.

A drive gear 7 is mounted to each of the camshafts 2 and 200 via a central fastener 29 for each of the camshafts 2 and 200. Although the drive gear 7 is illustrated, any type of drive member such as a gear, sprocket, pulley, or other such mechanical or electrical mechanisms could be operably assembled with the camshafts 2 and 200 and the one-piece camshaft bearing caps 5. The drive gear 7 will be discussed with respect to camshaft 2, however, the same discussion is applicable for the drive gear 7 assembled with the camshaft 200. The drive gear 7 sandwiches the one-piece camshaft bearing cap 5 between two thrust surfaces on the camshaft 2 and the drive gear 7 that are reacted through two surfaces 17 and 18 on the one-piece camshaft cap 5. When the drive gear 7 is assembled with the camshaft bearing cap 5 and the camshaft 2, these surfaces 17 and 18 on the camshaft bearing cap 5 control the fore and aft movement of the camshaft 2. The one-piece camshaft cap 5, camshaft 2 and the drive gear 7 are assembled together to form a camshaft assembly 30. The camshaft assembly 30 is then lowered into the cylinder head assembly 1 at which point the standard camshaft bearing caps 3 can be installed to secure the camshaft assembly 30 to the cylinder head assembly 1. FIG. 4 is also shown with a similar set of components for the camshaft 200. FIG. 4 illustrates a dual overhead camshaft ("DOHC") however this application is also applicable to single overhead camshaft ("SOHC") configurations. In one form, the camshaft bearing material is native to the camshaft bearing caps 3 and 5 also known as parent bore however a design that utilizes separate bearings or bushings could also be envisioned.

Figure 6A:
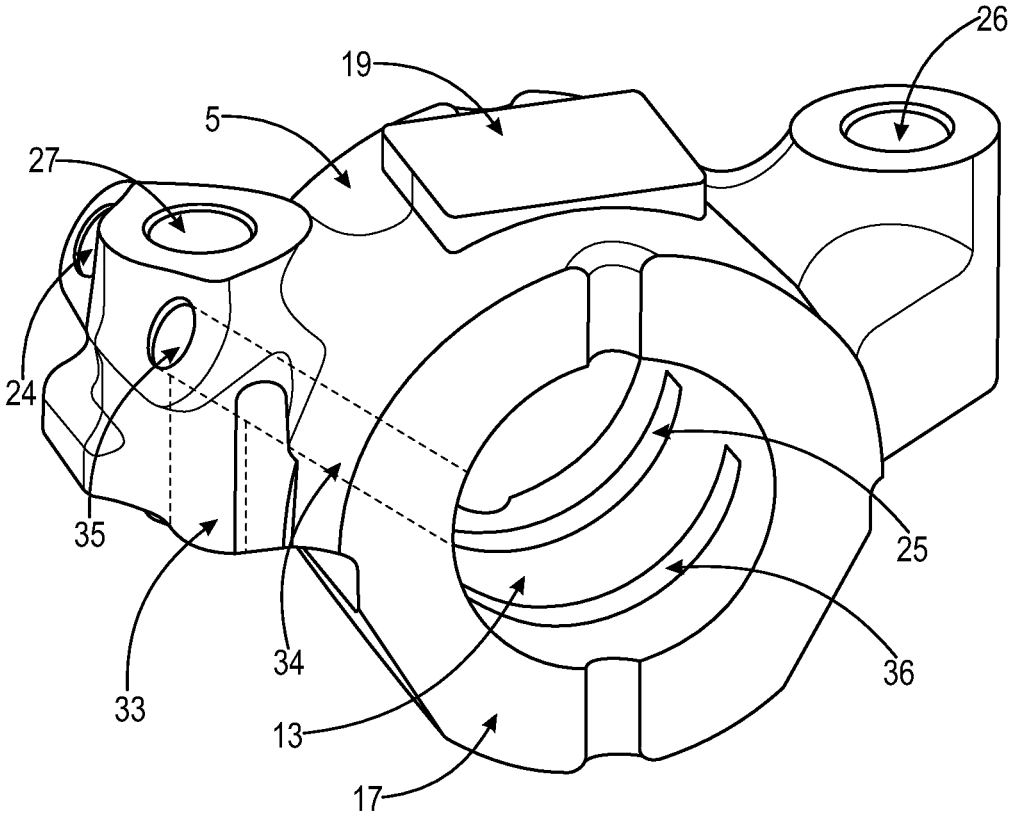
FIG. 6*a* is a top perspective view of a one-piece camshaft bearing cap of the cylinder head assembly of FIG. 4.
Figure 6B:
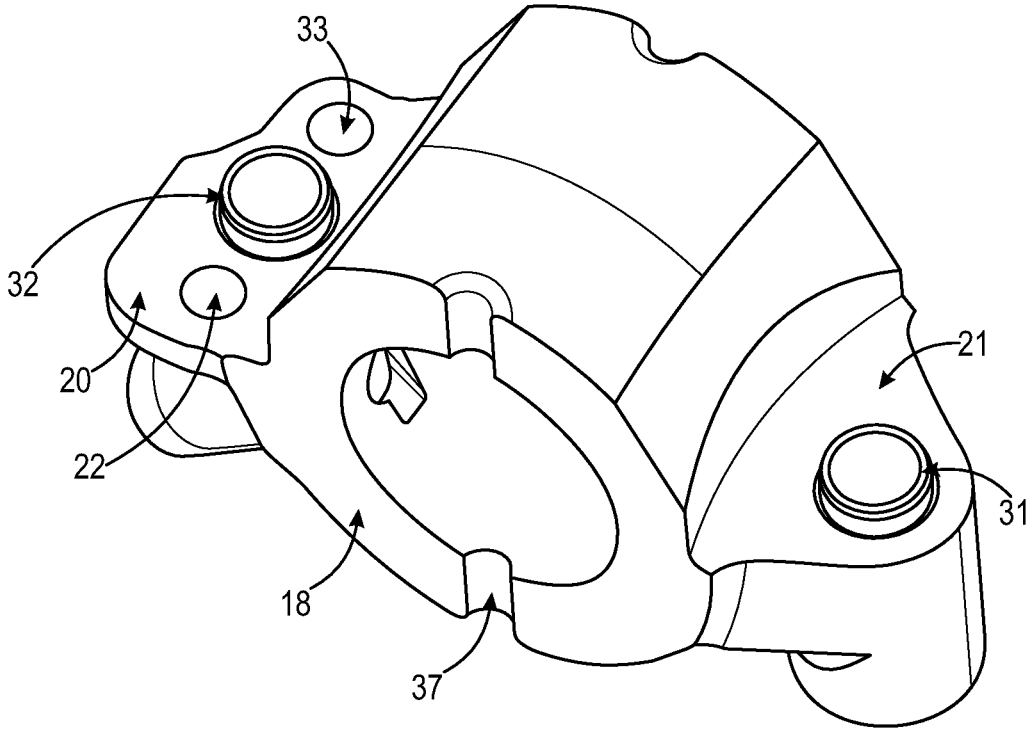
FIG. 6*b* is a bottom perspective view of the one-piece camshaft bearing cap of FIG. 6*a*.
Figure 6C:
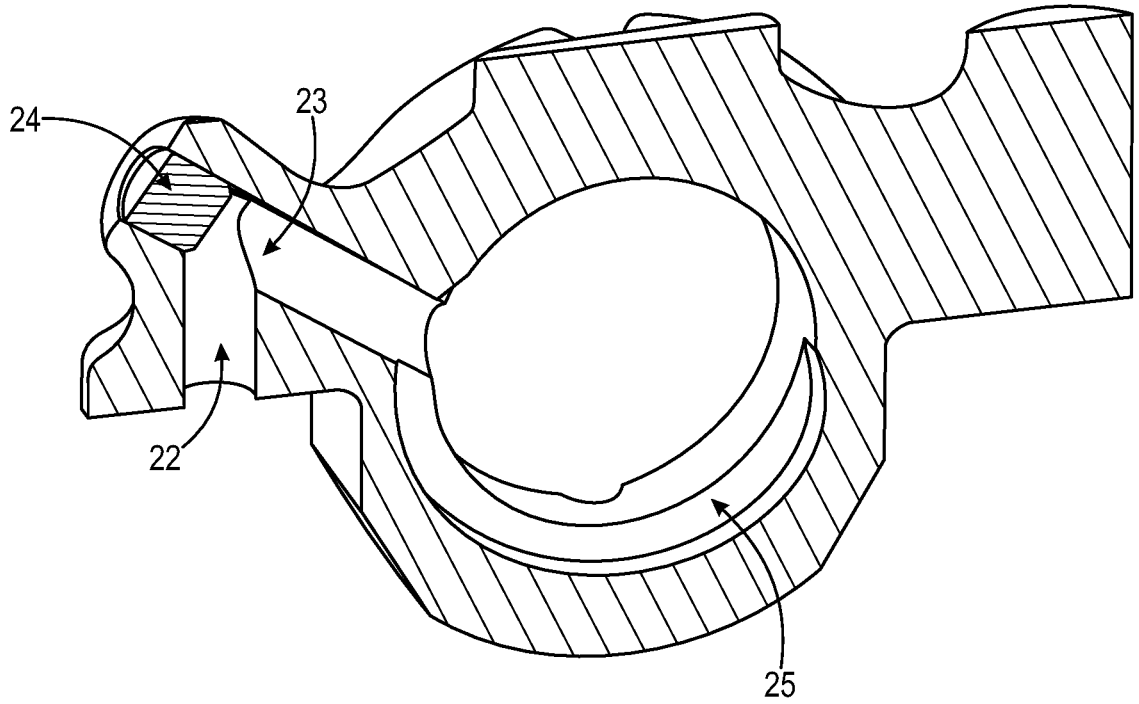
FIG. 6*c* is a cross-sectional view of the one-piece camshaft bearing cap of FIG. 6*a*.

FIGS. 6*a*, 6*b*, and 6*c* further detail the features of the one-piece camshaft bearing cap 5. The one-piece camshaft bearing cap 5 mounts to the cylinder head via two mounting bosses 26 and 27 that press against the cylinder head at surfaces 20 and 21. Two hollow dowels 31 and 32 are inserted into the mounting bosses 26 and 27 to ensure alignment of the one-piece camshaft bearing cap 5 with the standard camshaft bearing caps 3 when these are assembled with the camshafts 2 and 200. The fore and aft movement of the camshaft 2 and drive gear 7 are reacted or press against thrust surfaces 18 and 17 of the camshaft bearing cap 5 while splash engine oil is supplied to the thrust surfaces through four separate grooves 37 in the camshaft bearing cap 5. The one-piece camshaft bearing cap 5 includes a port or drilling 22 which is connected to a cross drilling 23 that feeds an oil supply groove 25 such that when oil is supplied into port or drilling 22 the oil then flows into the cross drilling 23 that then feeds the oil supply groove 25. A plug 24 is used to direct the flow from the drilling 22 into the cross drilling 23. The one-piece camshaft bearing cap 5 includes a port or drilling 33 (shown as dashed lines) wherein drilling 33 is connected to a cross drilling 34 (shown as dashed lines) that feeds an oil supply groove 36 such that when oil is supplied into the port or drilling 33 the oil flows into the cross drilling 34 that then feeds the oil supply groove 36. A plug 35 is used to direct the oil flow from the drilling 33 into the cross drilling 34. The oil supply grooves 25, 36 are separated to control oil flow to advance and retard chambers of a camshaft phaser 38 that is integrated into and assembled with the drive gear 7. The camshaft phaser 38 is assembled with the drive gear 7 with one or more bolts. Oil supply grooves 25, 36 either advance or retard the camshaft phaser 38 wherein the oil supply grooves 25, 36 function like a hydraulic mechanism to turn the camshaft 2 independent of gear 7 via the oil supply grooves 25, 36 in the one-piece camshaft bearing cap 5. Oil supply grooves 25, 36 connect to oil passages in the camshaft 2 that connect to oil passages in the phaser 38. In some embodiments, the oil supply grooves 25, 36 are not included and the cam phaser 38 is actuated without the oil supply grooves 25, 36 by an oil control actuator located directly in line with the camshaft phaser 38.

Oil circuits that include the oil supply grooves 25, 36 also supply the required oil to lubricate the camshaft bearing surface 14 during operation. A less complex oil circuit could be implemented if the camshaft phaser oil circuit including the cam phaser 38 was not required. Optionally, a pad 19 is provided on the one-piece camshaft cap 5 for location identification, serialization and any other markings required for manufacturing purposes.

Figure 7A:
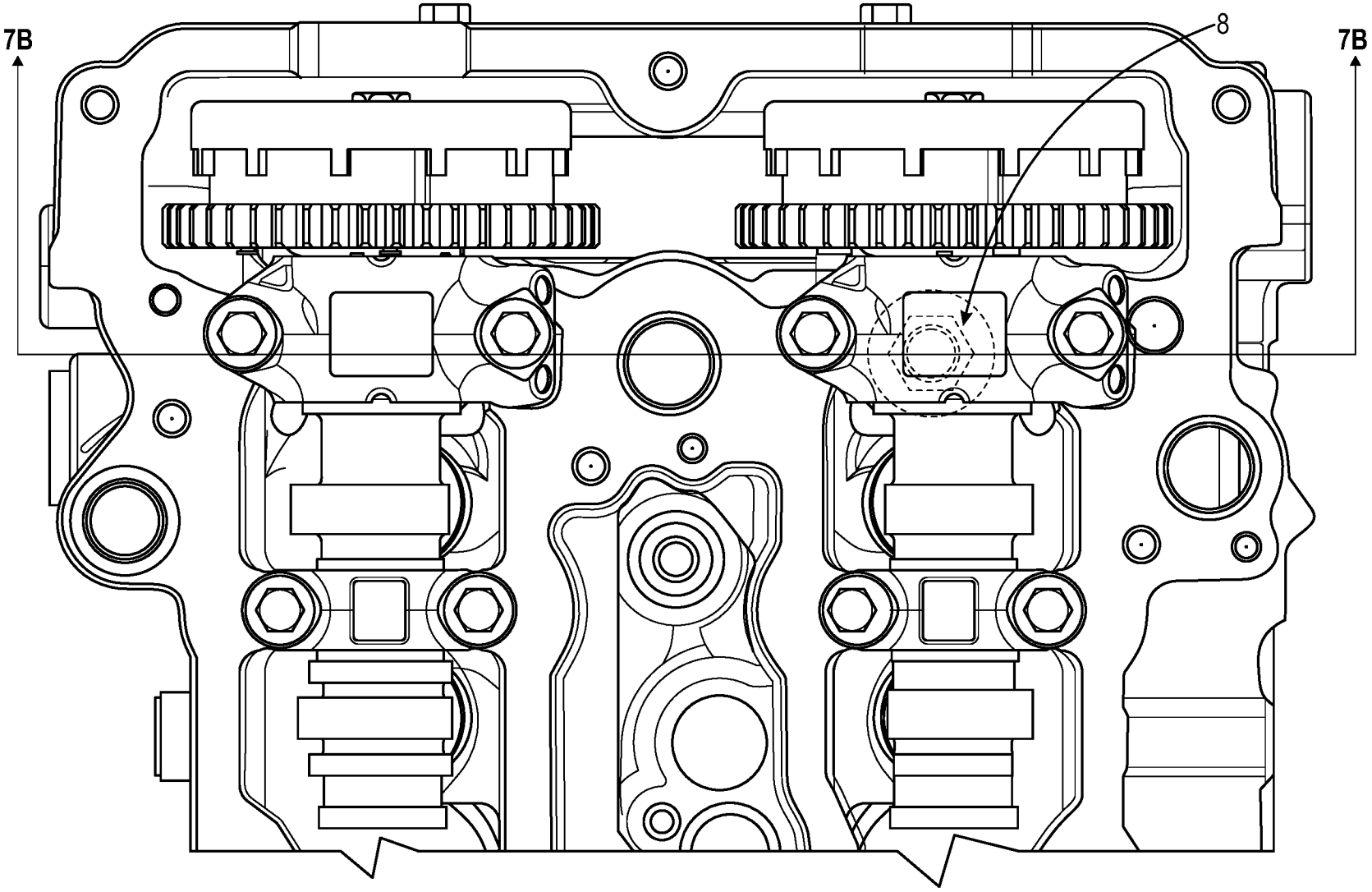
FIG. 7*a* is a partial top view of the cylinder head assembly of FIG. 4 in an assembled configuration.
Figure 7B:
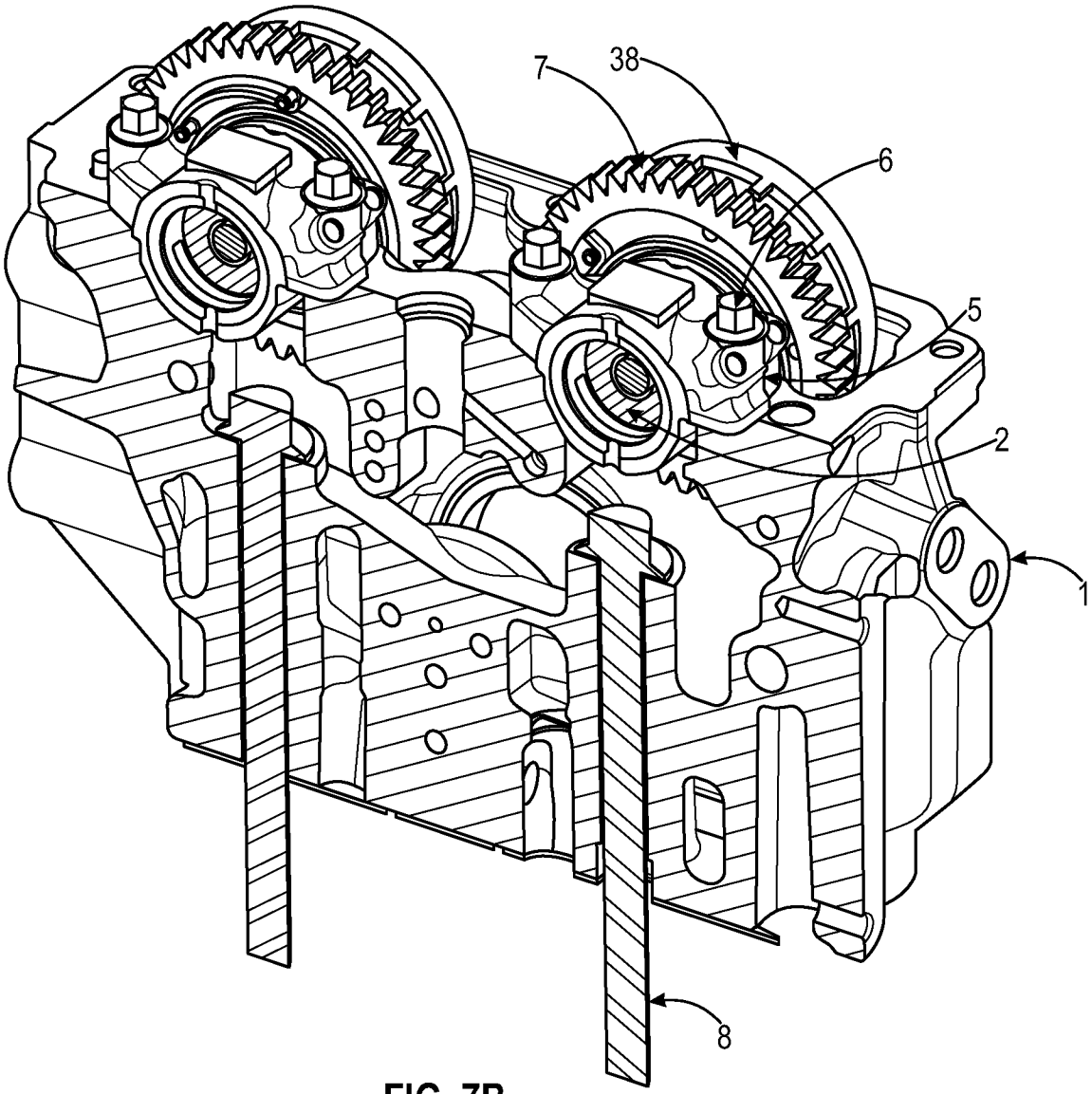
FIG. 7*b* is a cross-sectional view of the cylinder head assembly of FIG. 7*a*.

FIGS. 7*a* and 7*b* highlight some of the advantages of the one-piece camshaft bearing cap 5. As depicted the one-piece camshaft bearing cap 5 has 360 degrees of bearing support so there is no need for the cylinder head to support the lower half of the camshaft bearing surface 14 as is the case with the standard camshaft bearing cap 3. Thus, a head bolt 8 can be located directly underneath the one-piece camshaft bearing cap 5 wherein the head bolt 8 is configured to attach the cylinder head to the engine block. This is similar to an engine with a camshaft carrier wherein the head bolt is located directly underneath the camshaft carrier. Since the camshaft bearing cap 5 is a single piece, the camshaft bearing surface 14 is supported around its entire circumference of 360 degrees.

Figure 8:
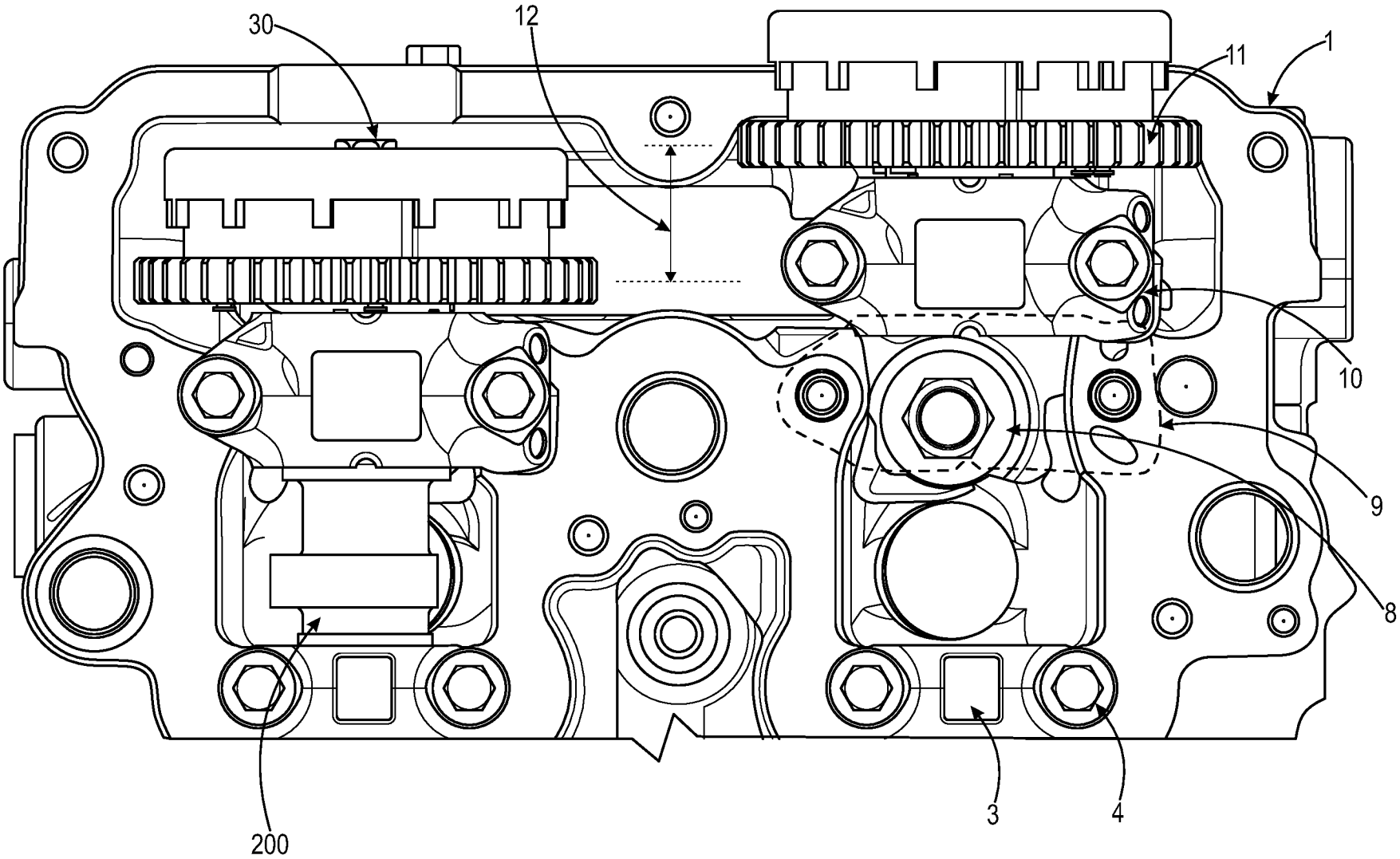
FIG. 8 is a partial top view of the cylinder head assembly of FIG. 4 in an assembled configuration on the left side of the figure, and a standard camshaft bearing cap assembled with a drive gear and a cylinder head on the right side of the figure.

Illustrated in FIG. 8 on the right side is a standard camshaft bearing cap assembled with a drive gear and a cylinder head. If the lower half of the camshaft bearing was to be formed by the cylinder head using traditional methods the camshaft cap outline 9 would need to shift into a second position 10 to enable line of sight access to the head bolt 8 for machining access requirements. Due to the movement of the camshaft cap to a second position 10 the mating camshaft drive gear 11 also needs to be repositioned by a delta amount 12 from its previous location shown by the camshaft layout on the left that corresponds to the camshaft assembly 30 assembled with the camshaft 200. Ultimately the arrangement using traditional methods wherein the camshaft cap and the mating camshaft drive gear 11 are shifted as depicted on the right side of FIG. 8 will require the overall engine to be longer by the delta amount 12. The camshaft assembly 30 beneficially shortens the length of the engine by the delta amount 12 as illustrated on the left side of FIG. 8.

Various aspects for the systems, methods and apparatus disclosed herein are contemplated. For example, one aspect includes a camshaft assembly for attachment to a cylinder head of an internal combustion engine, the camshaft assembly comprising: a camshaft having a camshaft bearing surface; a one-piece camshaft bearing cap having an internal bearing surface sized to slidably receive a portion of the camshaft therein, the internal bearing surface configured to support the camshaft bearing surface greater than or equal to 180 degrees circumferentially; and a drive gear operably assembled with the camshaft and the one-piece camshaft bearing cap.

In one example of this first aspect, wherein the one-piece camshaft bearing cap is positioned between a thrust collar on the camshaft and the drive member.

In a second example of this first aspect, the one-piece camshaft bearing cap can be disassembled from the camshaft such that the one-piece camshaft bearing cap remains a single piece.

In a third example of this first aspect, the internal bearing surface configured to support the camshaft bearing surface is between 180 degrees and 360 degrees circumferentially.

In a fourth example of this first aspect, further comprising: a camshaft phaser operably assembled with the drive member; and the internal bearing surface includes one or more oil supply grooves that advance or retard the camshaft phaser. In one refinement, the internal bearing surface includes one or more drillings that fluidly couple with the one or more oil supply grooves.

In a fifth example of this first aspect, further comprising: one or more head bolts configured to attach the cylinder head to the internal combustion engine. In one refinement, upon removal of the camshaft assembly the one or more head bolts that are attached to the cylinder head have line of sight access by an operator.

In a sixth example of this first aspect, further comprising: one or more standard camshaft bearing caps assembled with the camshaft and the cylinder head.

A second aspect includes an apparatus for assembly with a camshaft, the apparatus comprising: a single-piece camshaft bearing cap having an internal bearing surface with a diameter sized to receive a portion of the camshaft therein, the internal bearing surface configured to bear against a portion of a camshaft bearing surface greater than or equal to 180 degrees circumferentially, the internal bearing surface having one or more oil supply grooves.

In one example of this second aspect, the one or more oil supply grooves are configured to advance or retard a camshaft phaser assembled with the camshaft.

In a second example of this second aspect, the single-piece camshaft bearing cap includes one or more oil supply drillings fluidly coupled to the oil supply grooves.

In a third example of this second aspect, the internal bearing surface configured to bear against the portion of the camshaft bearing surface is between 180 degrees and 360 degrees circumferentially.

A third aspect includes a camshaft assembly for attachment to a cylinder head of an internal combustion engine, the camshaft assembly comprising: a one-piece camshaft bearing cap having an internal bearing surface sized to slidably receive a portion of a camshaft therein, the internal bearing surface configured to support a portion of a camshaft bearing surface greater than or equal to 180 degrees circumferentially, the one-piece camshaft bearing cap being removable to enable line of sight access by an operator to a mounting fastener on the cylinder head.

In one example of this third aspect, the camshaft includes a thrust collar, and the one-piece camshaft bearing cap is located adjacent the thrust collar.

In a second example of this third aspect, further comprising: a drive member operably assembled with the camshaft and the one-piece camshaft bearing cap.

In a third example of this third aspect, further comprising: a camshaft phaser operably assembled with the drive gear; and the internal bearing surface includes one or more oil supply grooves that advance or retard the camshaft phaser.

In a fourth example of this third aspect, the internal bearing surface is configured to support the portion of the camshaft between 180 degrees and 360 degrees circumferentially.

In a fifth example of this third aspect, the internal bearing surface has one or more oil supply grooves fluidly coupled to one or more drillings.

In a sixth example of this third aspect, further comprising: one or more standard camshaft bearing caps assembled with the camshaft and the cylinder head.

While the invention has been illustrated and described in detail in the drawings and foregoing description, the same is to be considered as illustrative and not restrictive in character, it being understood that only certain example embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A camshaft assembly for attachment to a cylinder head of an internal combustion engine, the camshaft assembly comprising:

a camshaft having a camshaft bearing surface;

a one-piece camshaft bearing cap having an internal bearing surface sized to slidably receive the camshaft bearing surface therein, the internal bearing surface configured to support the camshaft bearing surface greater than or equal to 180 degrees circumferentially;

a drive member operably assembled with the camshaft and the one-piece camshaft bearing cap; and a head bolt for attachment of the cylinder head to the internal combustion engine, wherein the camshaft, the one-piece camshaft bearing cap, and the drive member are configured to assemble as the camshaft assembly with the cylinder head such that the one-piece camshaft bearing cap is located directly above the head bolt.

2. The camshaft assembly of claim 1, wherein the one-piece camshaft bearing cap is positioned between a thrust collar on the camshaft and the drive member.

3. The camshaft assembly of claim 1, wherein the one-piece camshaft bearing cap can be disassembled from the camshaft such that the one-piece camshaft bearing cap remains a single piece.

4. The camshaft assembly of claim 1, wherein internal bearing surface configured to support the camshaft bearing surface is between 180 degrees and 360 degrees circumferentially.

5. The camshaft assembly of claim 1, further comprising:

a camshaft phaser operably assembled with the drive member; and the internal bearing surface includes one or more oil supply grooves that advance or retard the camshaft phaser.

6. The camshaft assembly of claim 5, wherein the internal bearing surface includes one or more drillings that fluidly couple with the one or more oil supply grooves.

7. The camshaft assembly of claim 1, wherein upon removal of the camshaft assembly the head bolt that is attached to the cylinder head has line of sight access by an operator.

8. The camshaft assembly of claim 1, further comprising:

one or more standard camshaft bearing caps assembled with the camshaft and the cylinder head.

9. An apparatus for assembly with a camshaft, the apparatus comprising:

a single-piece camshaft bearing cap having an internal bearing surface with a diameter sized to receive a camshaft bearing surface that extends around a circumference of the camshaft therein, the internal bearing surface configured to bear against the camshaft bearing surface greater than or equal to 180 degrees circumferentially, the single-piece camshaft bearing cap having an oil supply drilling fluidly coupled to a cross drilling to supply oil to the cross drilling, wherein the cross drilling is fluidly coupled to an oil supply groove in the internal bearing surface to supply oil to the oil supply groove.

10. The apparatus of claim 9, wherein the oil supply is configured to advance or retard a camshaft phaser assembled with the camshaft.

11. The apparatus of claim 9, wherein the internal bearing surface is configured to bear against the camshaft bearing surface between 180 degrees and 360 degrees circumferentially.

12. A camshaft assembly for attachment to a cylinder head of an internal combustion engine, the camshaft assembly comprising:

a one-piece camshaft bearing cap having an internal bearing surface sized to slidably receive a camshaft bearing surface that extends around a circumference of a camshaft therein, the internal bearing surface configured to support the camshaft bearing surface greater than or equal to 180 degrees circumferentially;

a drive gear operably assembled with the camshaft and the one-piece camshaft bearing cap; and a head bolt for attachment of the cylinder head to the internal combustion engine, the camshaft assembly configured to assemble with the cylinder head such that the one-piece camshaft bearing cap is located directly above the head bolt, the camshaft assembly configured to disassemble from the cylinder head to expose the head bolt.

13. The camshaft assembly of claim 12, wherein the camshaft includes a thrust collar, and the one-piece camshaft bearing cap is located adjacent the thrust collar.

14. The camshaft assembly of claim 12, wherein the internal bearing surface is configured to support the portion of the camshaft between 180 degrees and 360 degrees circumferentially.

15. The camshaft assembly of claim 12, wherein the internal bearing surface has one or more oil supply grooves fluidly coupled to one or more drillings.

16. The camshaft assembly of claim 12, further comprising:

one or more standard camshaft bearing caps assembled with the camshaft and the cylinder head.

17. The camshaft assembly of claim 12, further comprising:

a camshaft phaser operably assembled with the drive gear; and the internal bearing surface includes one or more oil supply grooves that advance or retard the camshaft phaser.

* * * * *